US006447382B1

(12) United States Patent
Potempka

(10) Patent No.: US 6,447,382 B1
(45) Date of Patent: Sep. 10, 2002

(54) APPARATUS FOR REMOVING SEMICONDUCTOR WAFERS FROM WITHIN THE RUNNER DISKS OF A DOUBLE-SIDED POLISHING MACHINE

(75) Inventor: Eberhard Potempka, Rendsburg (DE)

(73) Assignee: Peter Wolter Werkzeugmaschinen GmbH, Rendsburg (DE)

( * ) Notice: Subject to any disclaimer, the term of this patent is extended or adjusted under 35 U.S.C. 154(b) by 21 days.

(21) Appl. No.: 09/668,866

(22) Filed: Sep. 25, 2000

(30) Foreign Application Priority Data

Oct. 29, 1999 (DE) ..... 199 53 004
Feb. 18, 2000 (DE) ..... 100 07 389

(51) Int. Cl.[7] ..... B24B 47/02
(52) U.S. Cl. ..... 451/332; 451/388
(58) Field of Search ..... 451/331, 332, 451/334, 335, 364, 388, 65, 73, 9

(56) References Cited

U.S. PATENT DOCUMENTS 5,333,413 A * 8/1994 Hashimoto ..... 51/165.75
6,113,490 A * 5/2000 Hakomori ..... 451/288
6,135,854 A * 10/2000 Masumura et al. ..... 451/6
6,196,906 B1 * 3/2001 Hakomori ..... 451/339

FOREIGN PATENT DOCUMENTS

DE 195 47 086 6/1997

* cited by examiner

*Primary Examiner*—Timothy V. Eley
*Assistant Examiner*—Dung Van Nguyen
(74) *Attorney, Agent, or Firm*—Vidas, Arrett & Steinkraus

(57) ABSTRACT

An apparatus for removing semiconductor wafers from within the runner disks in a double-sided polishing machine. The apparatus includes a suction head adapted to be connected to a vacuum, which has a plurality of suction ports such that all semiconductor wafers received by a runner disk may be gripped simultaneously. The apparatus also includes an arm on which the suction head is rotatably supported about a vertical axis and which, in turn, is pivotally supported about a vertical axis at a spacing from the suction head or is supported so as to be linearly adjustable or adjustable in height. The apparatus also includes a rotary drive for the suction head, a drive for the arm, a lifting drive for the arm, and a control device for activating the drives such that the semiconductor wafers may be deposited on a lay-down device in a predetermined, aligned position.

11 Claims, 4 Drawing Sheets

APPARATUS FOR REMOVING SEMICONDUCTOR WAFERS FROM WITHIN THE RUNNER DISKS OF A DOUBLE-SIDED POLISHING MACHINE

CROSS-REFERENCE TO RELATED APPLICATIONS

Not Applicable

STATEMENT REGARDING FEDERALLY SPONSORED RESEARCH

Not Applicable

BACKGROUND OF THE INVENTION

This invention relates to an apparatus for removing semiconductor wafers from within the runner disks of a double-sided polishing machine.

It is known to work semiconductor slices or wafers (SC wafers) by means of polishing machines in such a way that a high degree of smoothness, non-defectiveness, and fineness of the surface is obtained. Such a double-sided polishing machine has become known from DE 195 47 086. Runner disks having three apertures, for example, to receive SC wafers interact with an outer and an inner pinned rim and are rotationally advanced if at least one of the pinned rims is driven. This causes the SC wafers to perform a cycloidal motion which is overlain by the rotation of the working disks. Thus, it is possible to machine parallel-sided surfaces on work pieces at a high accuracy.

The known machine also makes it possible to position the runner disks for the loading or unloading of the SC wafers. While this does not apply to the circumference of the runner disks it does apply to the center thereof. Hence, it is possible to stop the center of a runner disk at a predetermined point, using the drive of at least one pinned rim.

The runner disks have been fed and unloaded again by hand hitherto. Any manual handling of a freshly polished SC-wafer involves the risk that its polished surface might be damaged, e.g. by producing marks or scratches. Particularly critical are those damages which cover the front side of the SC wafer. Also, freshly polished SC wafers are extremely sensitive to non-controlled attack by chemicals such as an etching agent. As is known the polishing of such SC wafers using the machine described is a mechanical and chemical process. Any further chemical impact of the polishing agent is detrimental upon completion of the polishing process and, therefore, requires to be stopped as rapidly as possible, e.g. by transferring the SC wafer to a rinsing, neutralizing or cleaning bath.

Since the double-sided polishing operation on SC wafers as described is a so-called batch process a large number of SC wafers needs to be removed as rapidly as possible upon completion of the process.

It is the object of the invention to provide a device for removing SC wafers from within the runner disks in a double-sided polishing machine in which the SC wafers may be rapidly removed and deposited in an automatic manner with no manual step. Furthermore, the SC disks are intended to be removed in a desired order.

BRIEF SUMMARY OF THE INVENTION

The inventive device provides a suction head which may be connected to a vacuum and, in one aspect of the invention, may have one or more suction cups. These suction ports or suction cups are designed so that all of the SC wafers of a runner disk can be gripped and raised simultaneously. The suction head is adapted to be rotated by means of a votary drive for an alignment towards the SC wafers lying in a runner disk. The suction head, after being a swiveled to a lay-down device, may be adjusted again in a predetermined aligned position towards the lay-down device.

The suction head is rotatably supported on an arm, preferably a swivel arm which, in turn, is rotatably or adjustably supported about a vertical axis. In addition, the arm is adjustable in height by means of a lifting drive. A control device is provided for the individual drives to control the position of the arm and the suction head above a runner disk and the lay-down device.

As was already mentioned at the beginning the polishing machine is capable of precisely controlling the runner disks in their position between the pinned rims. Therefore, it is possible to precisely position each runner disk with respect to the removing apparatus. Hence, it is readily possible as well to use the control device for moving the arm to a position in which the axis of rotation of the suction head is aligned towards the center of a runner disk. Rotating the suction head will then make it possible to associate the suction ports and suction cups with the SC wafers received in the runner disk. In one aspect of the invention, this can be accomplished by the fact that a mark, e.g. a bore, is associated with a reception aperture of the runner disk and the suction head has a sensor for detecting the mark.

It is desirable and even prescribed frequently to take the SC wafers out of the polishing machine in the order in which they were inserted. For example, if the first SC wafer is placed by hand or machine in that reception aperture of the runner disk to which the mentioned marking belongs and further insertion is effected in a predetermined sense of rotation it will also be possible to deposit the SC wafers on a lay-down device in a predetermined orientation so that they may be conveyed, for example, to a reception cassette in the same direction as the one while they were loaded from the lay-down device.

In another aspect of the invention, the lay-down device has a circular plate adapted to be driven by a rotary drive which is subdivided into three sectors wherein each sector has at least one nest to receive a semiconductor wafer and is supported so as to be tiltable about a horizontal axis and one sector each is adapted to be aligned towards a transfer portion leading to a cassette. When a sector is tipped with an SC wafer received therein this one will slide, for example, on a film of a conveying liquid, to a reception cassette. Such a device has been known as such. The receiving circular plate is already in a liquid bath so that scratches or other harms to the surface are avoided during the conveyance described.

Preferably, the suction head has two suction cups for each SC wafer being removed, which cups lie on a radius of the SC wafer when the suction head is aligned towards the SC wafers. Preferably, a suction head will then lie aligned towards the center of the SC wafer.

Immersion baths are provided for the suction cups in the nests of the lay-down device and the lay-down circular plate. This allows to keep the suction heads wet and to rinse them during a break.

One aspect of the invention provides that the arm is pivotally supported about a vertical axis in a bearing component and is driven by a semirotary drive and that the bearing component is movably supported along a linear guide which is arranged between the polishing machine and another polishing machine where the bearing component is adapted to be displaced by an actuator drive along the guide. In this aspect of the invention, the unloading apparatus is capable of alternatively being employed on one of two polishing machines disposed next to each other by means of a linear transfer device. The mode of operation allows for two different options. First, the inventive unloading apparatus is able to effect the removal of wafers from within two double-sided polishing machines (single-stage process). The rate of process time in the unloading time is about 5%. Therefore, the unloading apparatus is preponderantly in a stop position. If two machines are linked by the inventive unloading apparatus the cost per SC wafer removed will be correspondingly lower. Furthermore, some mounting area and, possibly, an operator will be saved. One operator is required for each plant in case of two individual plants. In the inventive unloading apparatus, one operator may attend to two plants by using one unloading apparatus.

The inventive unloading apparatus may also be employed for a two-stage process in case of two double-sided polishing machines. At this point, the SC wafers, after undergoing machining, are transferred by means of the unloading apparatus from a first machine to the second machine which effects finishing. After finishing, the removing or unloading apparatus may deposit the SC wafers in the wet stockpiler.

It is known to support the upper polishing plate in a swivel-away position with respect to the lower one in order that there be a free access to the runner disks and SC wafers. If two double-sided polishing machines are disposed next to each other when the inventive unloading apparatus is used it is useful, therefore, to design the individual machines in such a way that the upper polishing plate be always swivelled away in a direction opposed to the polishing plate of the other machine in order that the machines may be juxtaposed very close to each other.

BRIEF DESCRIPTION OF THE SEVERAL VIEWS OF THE DRAWINGS

The invention will now be explained in greater detail with reference to an embodiment shown in the drawings.

DETAILED DESCRIPTION OF THE INVENTION

Figure 1:
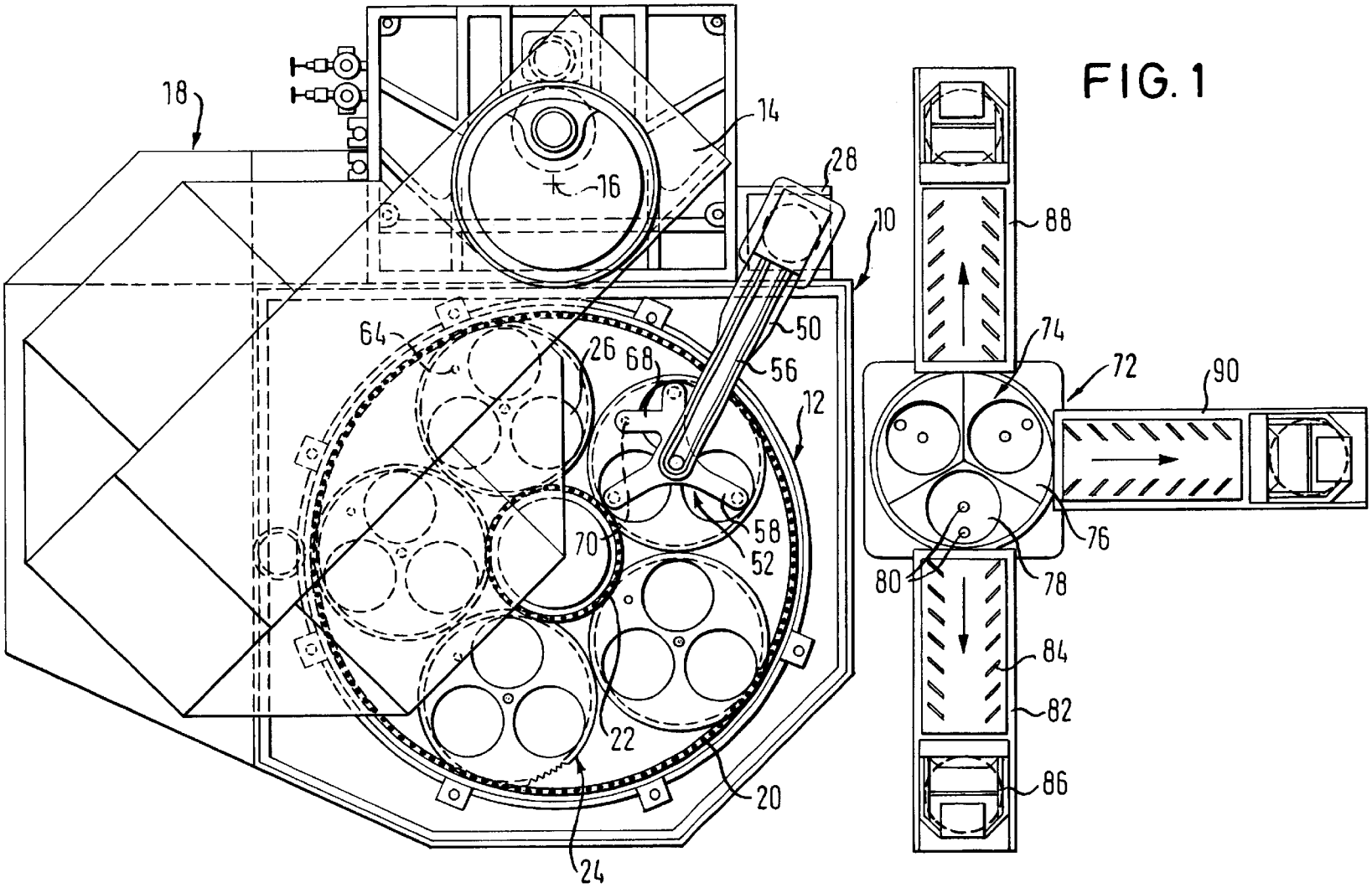
FIG. 1 shows a plan view of a polishing machine with the upper working disk swiveled away and having a removing device according to the invention.

While this invention may be embodied in many different forms, there are described in detail herein a specific preferred embodiment of the invention. This description is an exemplification of the principles of the invention and is not intended to limit the invention to the particular embodiment illustrated.

Referring to the Figures, 10 designates a machine frame of a double-sided polishing machine as has become known, for example, from DE 195 47 086. It has a lower working disk 12 which is rotatably supported in the machine frame and is adapted to be driven from a suitable drive which is not shown in detail. An upper working disk is pivotally supported on an arm 14 which is shown as partially having been swivelled away in a clockwise sense in FIG. 1. The upper working disk cannot be seen because of a cover 18. The arm 14 can be rotated about an axis of rotation 16 and is operated by a semirotary drive which is not shown either.

The lower working disk 12 is of an annular type. It is surrounded by an outer pinned rim 20, and an inner pinned rim 22 is inside the ring. One or either of the two pinned rims 20, 22 may be rotationally driven. Five runner disks 24, which are provided with outer teeth so as to be in engagement with the outer and inner annular rims 20, 22, are arranged in the annular region between the inner and outer pinned rims 22, 20. When the toothed rims are rotated the runner disks are rotated as well while being advanced at the same time. This has been known for such working machines, also especially for polishing machines, for example, from DE 195 47 086 which was mentioned above. The working disks are covered by a polishing cloth, and polishing liquid is fed during the polishing process.

Each runner disk 24 has tree reception bores spaced at 120° to receive a semiconductor wafer 26 as is also known as such FIG. 1 presupposes that each of the five runner disks 24 is loaded with three SC wafers each which have been machined before and are now intended to be gradually unloaded. This is accomplished with the aid of an unloading apparatus which will now be described in detail. A bracket 28 is mounted on the machine frame 20. It carries a motor 30 with a gearbox 32 and a pinion shaft 34. A special bearing 36 having inner teeth constitutes a rotational connection to a lifting unit 38. The lifting unit 38 may be pivoted about a vertical axis by means of the motor 30. It is understood that the pivoting motion may also be substituted for by a linear motion. The lifting unit 38 has a runner component 40 which holds a motor 42 and has a linear guide 44 for a carriage 46. The carriage 46 is coupled to a motor 42 via a screw drive 48, which is not described or illustrated in detail, in order that a lifting motion at minimal increments may be performed in a freely programmable manner. The carriage 46 holds a swivel arm 50 on which a motor 52' shown in dotted lines is arranged. The swivel arm 50 has rotatably supported at the free end a suction head 52 about a vertical axis 54. In addition, it may be rotationally driven by a motor 52' via a belt 56 which couples a driven wheel of the motor 52' to a wheel on the head 52. As can be seen from FIG. 1 the head 52 as three arms 58 disposed at spacings of 120°. Each arm has two suction cups 60, 61 which lie on the radius of a SC wafer 26 when the axis 54 is aligned towards the center of a runner disk 24 and the arms 58, in turn, are aligned towards the SC wafers 26. As is apparent from FIG. 2 the suction cups 60, 61 are connected to a vacuum source not shown in detail via appropriate lines 62.

Each runner disk 24 has a bore 64 which is associated with a reception aperture. While the polishing machine is loaded the SC wafers being processed are manually inserted in a way that the reception aperture associated with the bore 64 is loaded first and the remaining reception apertures are loaded subsequently in a predetermined sense of rotation. This loading operation then continues for each runner disk 24 in the same manner.

An arm 58 of the suction head 52 has a lateral arm 68 on which a sensor 70 is mounted. As is apparent from FIG. 2 it projects downwards like a pin and is situated slightly above the plane of the lower ends of the suction heads 60, 61. The sensor 70 helps in detecting the bore 64 of a runner disk 24 in order that the suction head be moved to a desired rotational position at a place above a runner disk with the arms 58 being appropriately arranged with respect to the SC wafers 26.

A lay-down device 72 is shown on the right-hand side next to the machine frame 10 in FIG. 1. It has a lay-down circular plate 74 which is adapted to be indexed in steps of 120° by means of a rotary drive which is not shown in detail. The circular plate 74 has three segments 76 each of which has a nest 78 to receive an SC wafer. Arranged in each of the nests 78 and lying on a radius are two immersion baths 80 for the suction cups 60, 61 of the suction head 52. More reference thereto will be made farther below. Each sector 76 may be tilted about a horizontal axis by means of a displacing device which is not shown in detail.

Each sector 76 may be aligned towards a chute 82 which is flowed over by a liquid film which is fed through slotted apertures 84. Such a device is known as such. The chute conveys SC wafers received to a cassette 86 which is adjustable in height and is supported in the frame not shown in detail of the lay-down device 72 in order to gradually receive the incoming SC wafers. The entire lay-down device is in a cleaning and neutralization bath.

As is outlined at 88 and 90, the transfer device leading from the lay-down circular plate 74 to the cassettes may also be positioned in another arrangement.

The way of action of the device described will now be explained.

The runner disks 24, when in the final phase of the polishing process, are positioned by means of a device as has become known from DE 195 47 086, namely in a way that the runner disk which was loaded first, e.g. runner disk 26, will be stopped below the swivel arm 50 with the SC wafers 1, 2, and 3 being in the desired position. While the position of the reception bores of the runner disk and, hence, the position of the SC wafers 26 is unknown the position of the center of the runner disk 24 is known. When this positioning applies the upper working disk can have been swivelled away already or can be swiveled away as is shown in FIG. 1. Once the positioning of the first runner disk is completed the swivel arm 50, along with the suction head 52, will be swivelled above the runner disk 24 with the axis of rotation 54 being aligned with the center of the runner disk. Subsequently, the suction head 52 is rotated by means of an appropriate localizing device until the sensor 70 has been aligned with the bore 64 of the runner disk. Because if the runner disks are loaded manually that aperture of the runner disk which is closest to the bore 64 will always be loaded initially the control unit "knows" which SC wafer to unload first. This is of significance for the lay-down operation later. After the suction head 52 is aligned a vacuum is applied to the suction cups 60, 61 and all SC wafers 26 of a runner disk may be raised simultaneously and may be positioned above the lay-down circular plate 74 by means of the swivel arm 50. During this swiveling motion, the suction head 52 is turned, by means of the aforementioned rotational drive motor 52*a,* to its neutral position. In this position, that SC wafer 26 which is intended to be removed initially will be opposite the chute 82. Subsequently, the SC wafers are deposited in the nests 78 of the circular plate 74 by lowering the arm 50 and eliminating the vacuum. Tilting the first sector may then cause the first SC wafer to migrate to the cassette 86 via the chute 86. Subsequently, the rotary drive which is not shown will rotate the circular plate 74 through 120° so that the No. 2 SC wafer is aligned towards the chute 82. Finally, the No. 3 SC wafer will be removed in the same manner.

The rotary drive of the machine has meanwhile positioned the next runner disk 74 in der manner described and unloading is effected again in the manner described. Thus, the SC wafers may be unloaded in a speedy manner and in the order in which the machine also was loaded.

The suction cups 60, 61 may be lowered into immersion baths 80 of the circular plate 74 during a break in order to be kept wet and undergo rinsing.

Figure 2:
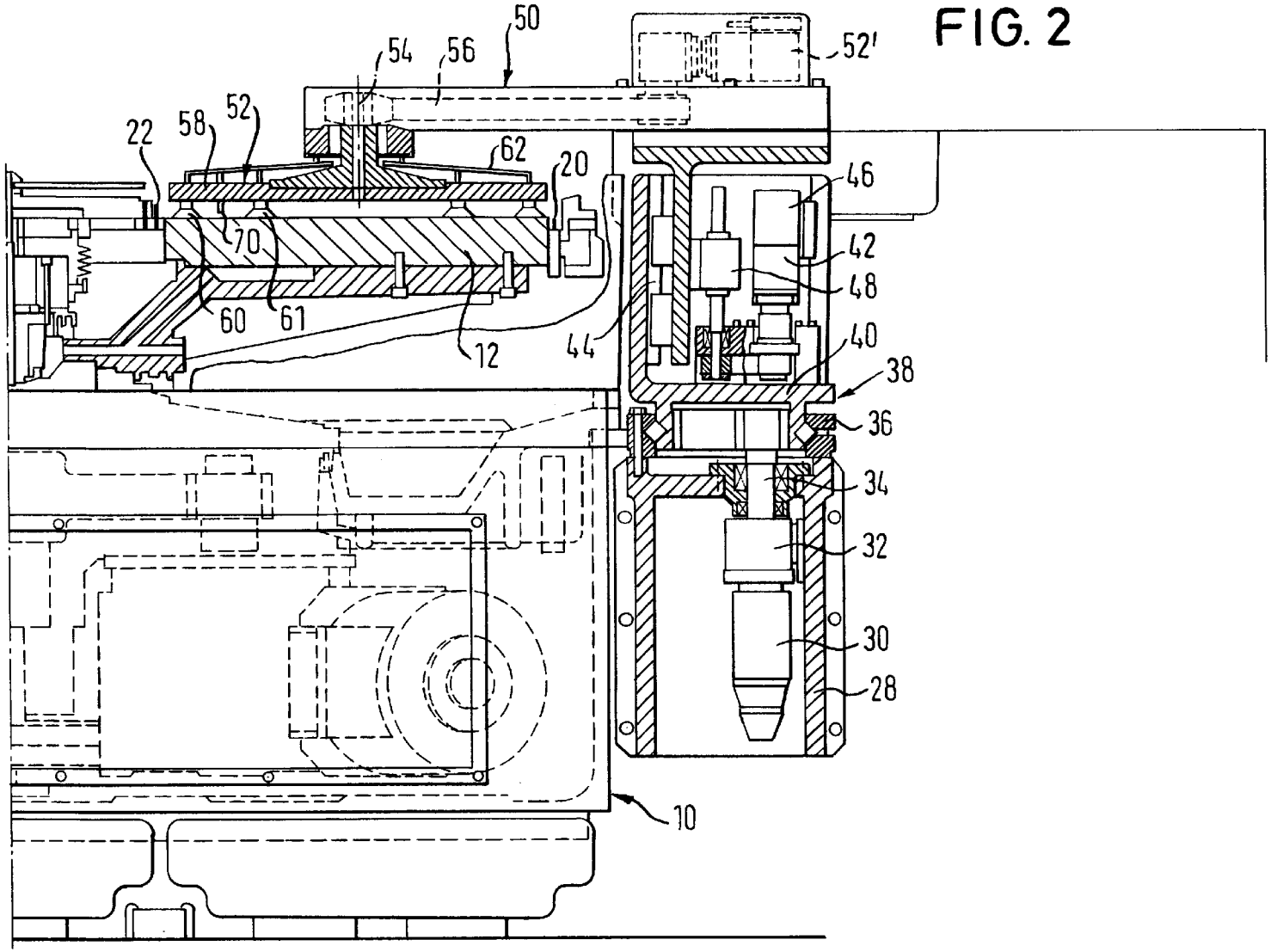
FIG. 2 shows a section through the right-hand half of the polishing machine of FIG. 1 and through the removing apparatus.

The polishing machine illustrated in FIGS. 1 and 2 serves for machining SC wafers 12 inches in diameter. However, it is also possible to work smaller SC wafers the diameter of which is 8 inches, for instance, on such machines. In this case, the runner disks will have 6 reception apertures and the suction head 52 is provided with six arms having suction cups for raising six SC wafers at a time in a runner disk. The lay-down circular plate for the lay-down device, however, is shaped in a way similar to that of FIG. 2. A sketch thereof is shown in FIG. 3.

Figure 3:
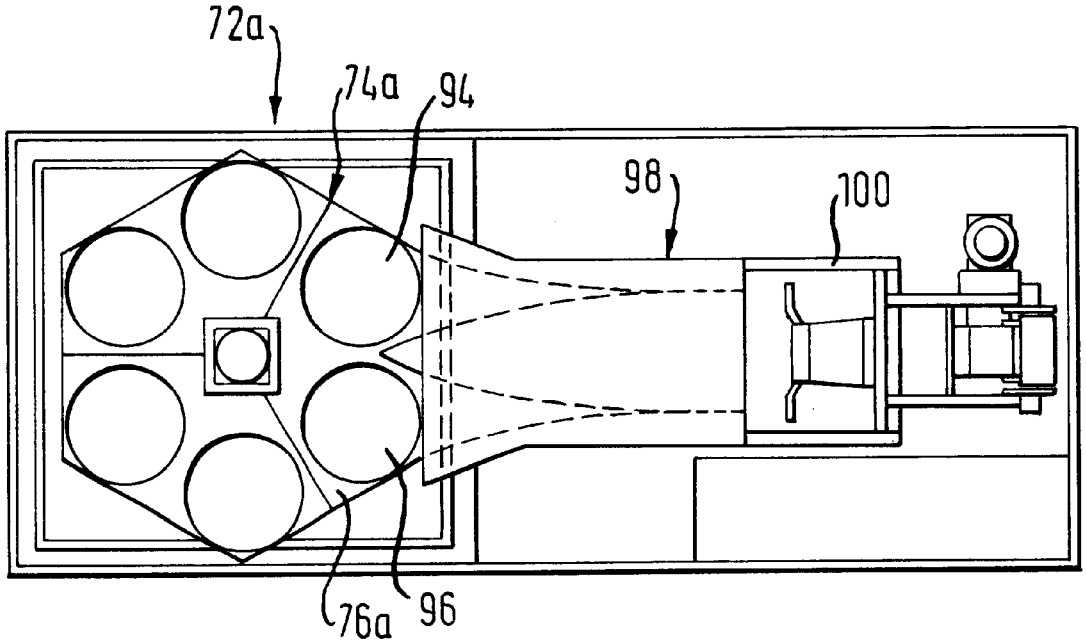
FIG. 3 shows a plan view of another embodiment of a lay-down device for the removing apparatus of FIGS. 1 and 2.

The lay-down circular plate 74*a* of the lay-down device 72*a* as shown in FIG. 3 also has three sectors 76*a*. Each sector 76*a* has two lay-down nests 94, 98 to receive SC wafers. For the rest, the sectors 76*a* are adapted to be tilted about a horizontal axis as are the corresponding sectors 76 of FIG. 1 and the lay-down circular table 74*a* may be indexed in steps of 120° in order to align one sector 74*a* each towards a transfer line 98 leading to a station 100 in which a cassette is arranged so as to be adjustable in height (which is not shown in detail). Unlike the transfer line of FIG. 1, the transfer line 98 has two different planes to simultaneously convey SC wafers from the two nests 94, 98 to the cassette. Like the nests 78 of FIG. 1, the nests 94, 98 may be provided with immersion baths for the suction cups of the suction head.

Figure 4:
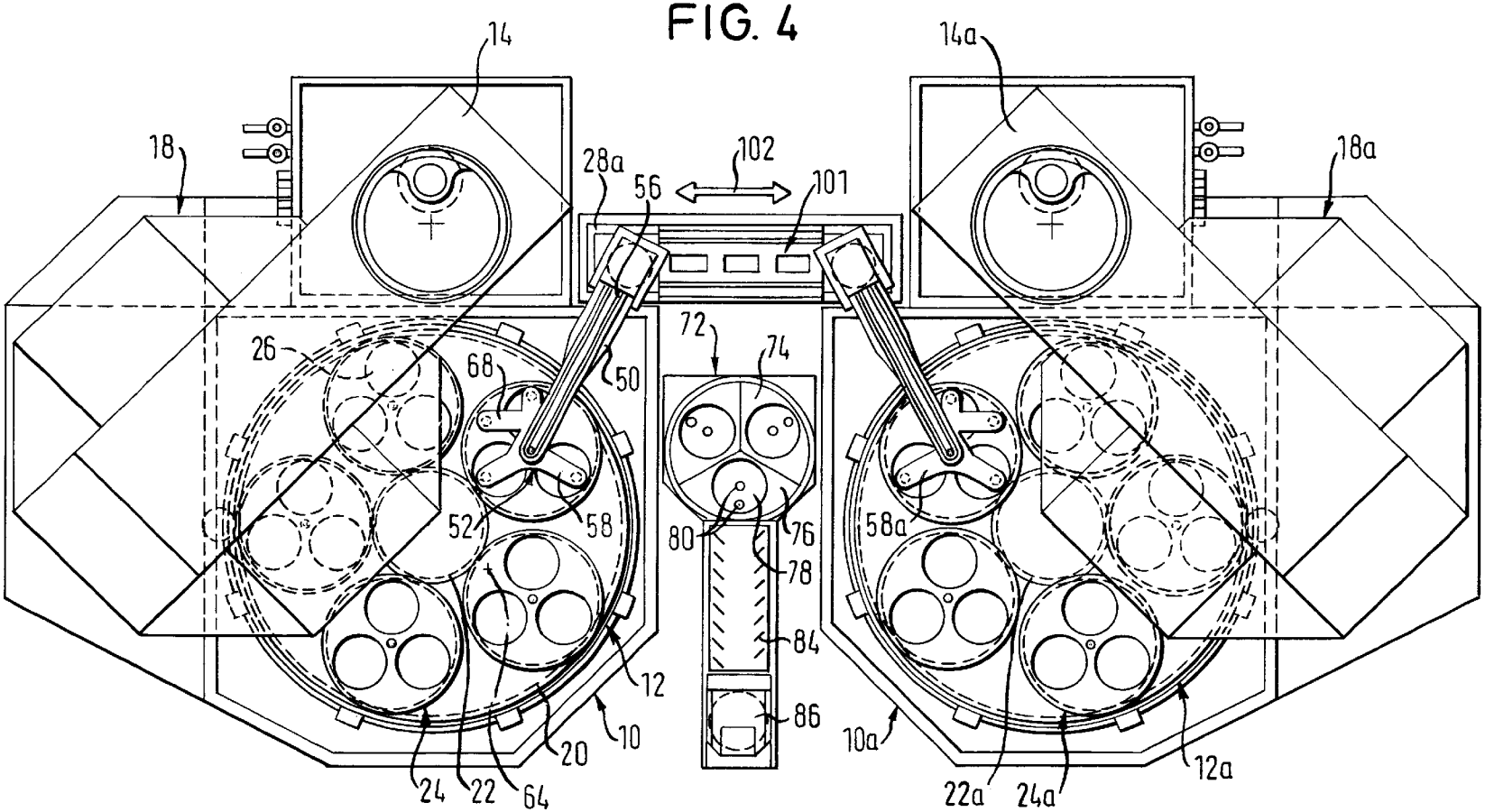
FIG. 4 shows a plan view of two polishing machines with the upper polishing plates swivelled away and having a removing apparatus in another aspect of the invention for the two polishing machines.

In the embodiment of FIG. 4, two double-sided polishing machines are disposed next to each other. The left-hand one is identical to the double-sided polishing machine of FIG. 1. Likewise, the lay-down device (wet-type feeder) is identical to that of FIG. 1. In addition, the right-hand side of FIG. 4 shows another double-sided polishing machine the structure of which is identical to that of the double-sided polishing machine shown on the left except that its upper polishing disk (which cannot be seen either) is adapted to be pivoted in an anticlockwise sense when swiveled away from the lower working disk 12*a*, in contrast to the left-hand machine in which the upper polishing disk is pivoted in a clockwise sense. For the rest, the reference numbers of the left-hand machine are equal to those of the machine of FIG. 1 and the right-hand machine of FIG. 4 also has the same reference numbers to which an index a is added.

In FIG. 4, the bracket which pivotally supports the swivel arm 50 about a vertical axis to make it adjustable in height and which is indicated by 28 in FIG. 2 may be displaced along a linear guide 101 between the machines in a horizontal direction along the double arrow 102. This purpose is served by an actuator drive which is not shown. Thus, the unloading apparatus 50 may be used in optionally operating the left-hand and the right-hand polishing machine. FIG. 4 depicts the operation of the right-hand polishing machine from the unloading apparatus with the unloading apparatus 50 being shown in dotted lines. Hence, semiconductor wafers may be deposited in the lay-down device 72 from both the one and other machine. It is also possible to transfer the semiconductor wafers from one machine to the other machine if a so-called two-stage process is carried out.

The above Examples and disclosure are intended to be illustrative and not exhaustive. These examples and description will suggest many variations and alternatives to one of ordinary skill in this art. All these alternatives and variations are intended to be included within the scope of the attached claims. Those familiar with the art may recognize other equivalents to the specific embodiments described herein which equivalents are also intended to be encompassed by the claims attached hereto.

What is claimed is:

1. A double-sided polishing machine, comprising:

an upper polishing disk, a lower polishing disk, and runner disks on the lower polishing disk having openings for accommodating wafers, the runner disks being moved between the polishing disks upon rotation of the polishing disks for machining both surfaces of the wafers;

control means adapted to stop the movement of the runner disk such that the runner disks attain a precise predetermined position on the lower polishing disk;

an unloader assembly provided adjacent the polishing machine and said unloader assembly having a single arm member supporting a suction head designed to rotate about a first vertical axis, the suction head being provided with a plurality of suction ports for a contemporary engagement of all wafers in a runner disk, the arm member having a vertical axis at a predetermined spacing from the first vertical axis about which the arm member is rotatably supported between a first position wherein the suction head is above a lay-down device and a second position wherein the first vertical axis of a suction head is aligned with the center of one runner disk in the predetermined position, the runner disk further having a mark associated with one opening of the runner disk and the suction head having one sensor for detecting the mark during rotation of the suction head aligned with the runner disk to align the suction ports with the individual wafers in the runner disk.

2. The apparatus according to claim 1, characterized in that the runner disks (24) have a mark (64), the suction head (52) has a sensor (70) for detecting the mark (64) and the control device, while rotating the suction head (52), moves it to a predetermined rotational position relative to the runner disk (24).

3. The apparatus according to claim 2, characterized in that the mark (64) is a deepened space.

4. The apparatus according to claim 1, characterized in that the suction head (52) has two suction cups (60, 61) for each semiconductor wafer (26) which lie on a radius of the semiconductor wafer (26) when the suction head (52) is aligned towards a runner disk (24).

5. The apparatus according to claim 4, characterized in that one suction cup (61) is aligned towards the centre of the respective semiconductor wafer (26).

6. The apparatus according to claim 1, characterized in that the lay-down device (72) has a circular plate (74) adapted to be driven by a rotary drive which is subdivided into three sectors **(76, 76*a*) wherein each sector (76, 76*a*) has at least one nest (78, 78*a*) to receive a semiconductor wafer and is supported so as to be tiltable about a horizontal axis and one sector (76, 76*a*) each is adapted to be aligned towards a transfer portion (82, 98)** leading to a cassette.

7. The apparatus according to claim 1, characterized in that immersion baths (80) for the suction cups (60, 61) of the suction head (52) are arranged in the nests **(78, 78*a*)**.

8. The apparatus according to claim 1, characterized in that the arm (50) is mounted on a carriage (46) which is held on a carrier element (38) having a linear guide (44) so as to be guided vertically and that the carrier element (38) is rotatably supported on the machine frame (10, 28).

9. The apparatus according to claim 1, characterized in that the arm (50) is pivotally supported about a vertical axis on a bearing component **(28*a*) and is driven by a swivel drive and that the bearing component (28*a*) is movably supported along a linear guide (101) which is arranged between the polishing machine and a second polishing machine and that the bearing component (28*a*) is adapted to be displaced by an actuator drive along the guide (101)**.

10. The apparatus according to claim 9, characterized in that the upper polishing disks of the two polishing machines are pivotally supported about a vertical axis towards opposed sides.

11. An apparatus for removing semiconductor wafers from within runner disks in a double-sided polishing machine, comprising:

a suction head (52) adapted to be connected to a vacuum, which has a plurality of suction ports (60, 61) such tat all semiconductor wafers (26) received by a runner disk (24) may be gripped simultaneously;

an arm (50) on which the suction head (52) is rotatably supported about a vertical axis and which, in turn, is pivotally supported about a vertical axis at a spacing from the suction head or is supported so as to be linearly adjustable or adjustable in height;

a rotary drive (52') for the suction head (52), a drive (30) for the arm (50), a lifting drive for the arm (50), and a control device for activating the drives such that the semiconductor wafers (26) may be deposited on a lay-down device (72) in a predetermined, aligned position;

a mark (64) on the runner disks that is a deepened space.

* * * * *